US007232168B2

(12) United States Patent
Orefice

(10) Patent No.: US 7,232,168 B2
(45) Date of Patent: Jun. 19, 2007

(54) BAGGY BUDDY GROCERY AND DEPARTMENT STORE BAG CARRY HANDLE

(76) Inventor: Richard Orefice, 1300 NE. 3 St. 29, Ft. Laud., FL (US) 33301

( * ) Notice: Subject to any disclaimer, the term of this patent is extended or adjusted under 35 U.S.C. 154(b) by 0 days.

(21) Appl. No.: 11/219,543

(22) Filed: Nov. 2, 2005

(65) Prior Publication Data

US 2007/0096485 A1 May 3, 2007

(51) Int. Cl.
*B65D 33/06* (2006.01)

(52) U.S. Cl. ..... 294/137; 294/142; D9/434

(58) Field of Classification Search ..... 294/137, 294/142, 158; D9/434, 455; 224/257, 925
See application file for complete search history.

(56) References Cited

U.S. PATENT DOCUMENTS

| | | | | |
|---|---|---|---|---|
| 4,621,855 | A | 11/1986 | Kroll | |
| 4,772,059 | A | 9/1988 | Parry et al. | |
| D359,235 | S * | 6/1995 | Kennedy et al. | D9/434 |
| 5,433,494 | A | 7/1995 | Du Bulsson | |
| 5,441,323 | A | 8/1995 | Goddard | |
| D386,682 | S | 11/1997 | Richardson et al. | |
| 5,697,661 | A | 12/1997 | Robinson, Sr. et al. | |
| D394,351 | S * | 5/1998 | Henderson | D3/328 |
| D400,785 | S * | 11/1998 | Randall | D9/434 |
| 5,855,403 | A | 1/1999 | Harper | |
| 5,904,388 | A | 5/1999 | Seibel | |
| 5,921,601 | A * | 7/1999 | Buckles | 294/142 |
| 6,247,739 | B1 * | 6/2001 | Lyon | 294/159 |
| 6,347,822 | B1 | 2/2002 | Miller, Jr. | |
| 6,499,781 | B1 | 12/2002 | Flynn | |
| 6,623,056 | B1 * | 9/2003 | Wickson | 294/158 |
| D483,668 | S * | 12/2003 | Le Roux | D9/434 |

FOREIGN PATENT DOCUMENTS

FR 2 652 563 * 4/1991

* cited by examiner

*Primary Examiner*—Dean J. Kramer
(74) *Attorney, Agent, or Firm*—Allen D. Hertz

(57) ABSTRACT

A carrier in the shape of a triangle for carrying multiple plastic bags with handles, shopping bags with handles, or items with carry handles, straps, bands, loops or hooks. The handle body uses a small opening in the top center of the grasping portion for the insertion of the items to be carried which is secured shut by the hand of the person carrying the handle. The lowest center point of the triangle shape allows the handles carried to settle at a central, low point, for a secure and balanced load carrying ability. The opposing faces of the handle body have an I shaped cross section for comfortable, secure carrying along with increased rigidity, strength, and a secure gripping surface. Two notches on the inner surface of the grasping portion of the handle allow for the attachment of a carrying strap to free the hands of the user.

12 Claims, 4 Drawing Sheets

BAGGY BUDDY GROCERY AND DEPARTMENT STORE BAG CARRY HANDLE

FIELD OF THE INVENTION

The present invention relates generally to a carrying device, more specifically a hand held or shoulder strap held "V" shaped device for aiding in carrying one or more bags.

BACKGROUND OF THE INVENTION

There have long been carrying devices for engaging bag handles to carry one or more bags such as plastic shopping bags. A problem has been that prior bag holders do not hold the bags in a centrally balanced position, so that the bags can slide in the holder during carrying and can become unstable and inconvenient to use.

Another disadvantage of prior bag carrying handles is that they are not designed to allow the attachment of a carrying strap that can be slung over a shoulder to allow the use of the hands of the person carrying the bags for other purposes such as opening doors, carrying other objects, or any other use deemed necessary by the person carrying the bags.

Bag carrying devices have taken a variety of forms, such as that of Winborne, U.S. Pat. Des. 374,622 which has an unneeded keeper making it difficult to remove the bag handles from the device. And only allows the attachment of any kind of strap or lanyard from one point on the device, which, if attached would create an unstable situation, while allowing the bag handles to slide thru the opening by the keeper across from the point of attachment. Wickson, U.S. Pat. No. 6,623,056 which shows a looped bag holder with an opening at the top that is too small to allow the easy entry or removal of the plastic bag handles, and does not allow for attachment of a carrying strap for heavy loads.

Other prior Patents included in the following Classes and Sub-classes: 294, 137, 142, 153, 158, are as follows: U.S. Pat. Nos.:

A) 386,682
B) 4,621,855
C) 4,772,059
D) 5,433,494
E) 5,441,323
F) 5,697,661
G) 5,855,403
H) 5,904,388
I) 6,347,822
J) 6,499,781

SUMMARY OF THE INVENTION

The present invention accomplishes the above-stated objectives, as well as others, as may be determined by a fair reading and interpretation of the entire specification.

The present invention presents a holder and carrying handle (Baggy Buddy) designed to carry multiple bags, items other than bags with a carrying loop, and the like. The holder and carrying handle are shaped as a "V" oriented triangle, with curved angles for comfortable hand gripping, and orientated with the longer side on the top as the gripping portion for gripping with the users hand, with a small, centrally located opening within the longer side for the insertion of a plurality of handles. And the apex of the "V" section of the triangle orientated as the lower portion of the handle to center the bag handles at the bottom of the handle to establish a low, centralized, center of gravity at the bottom of the handle and create a more secure and balanced load carrying ability.

Two (2) notches are placed along the interior of a gripping portion of the handle near the opposing ends of the gripping section. The two notches are used to secure a shoulder carry strap to the handle using two "D" rings that are fastened to the opposing ends of the shoulder carry strap assembly. This allows for an easier way to carry the handle with bags secured without the use of the users hand.

The holder body has a substantially V-shape allowing the bag handles to create a center of gravity at the bottom of the handle for balance, stability and control.

The inner, bottom side of the gripping portion of the handle has two indented notches allowing for the attachment of a shoulder carrying strap for handle free carrying of the load held by the carrying handle.

The cross section of the handle has I shape allowing for structural strength, comfort to the holder's hand, and a positive gripping surface.

The removable carry strap can be attached after inserting the bag handles to allow for a greater weight carrying capacity, and the free use of the hands of the person carrying the bags.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE DRAWINGS

Figure 1:
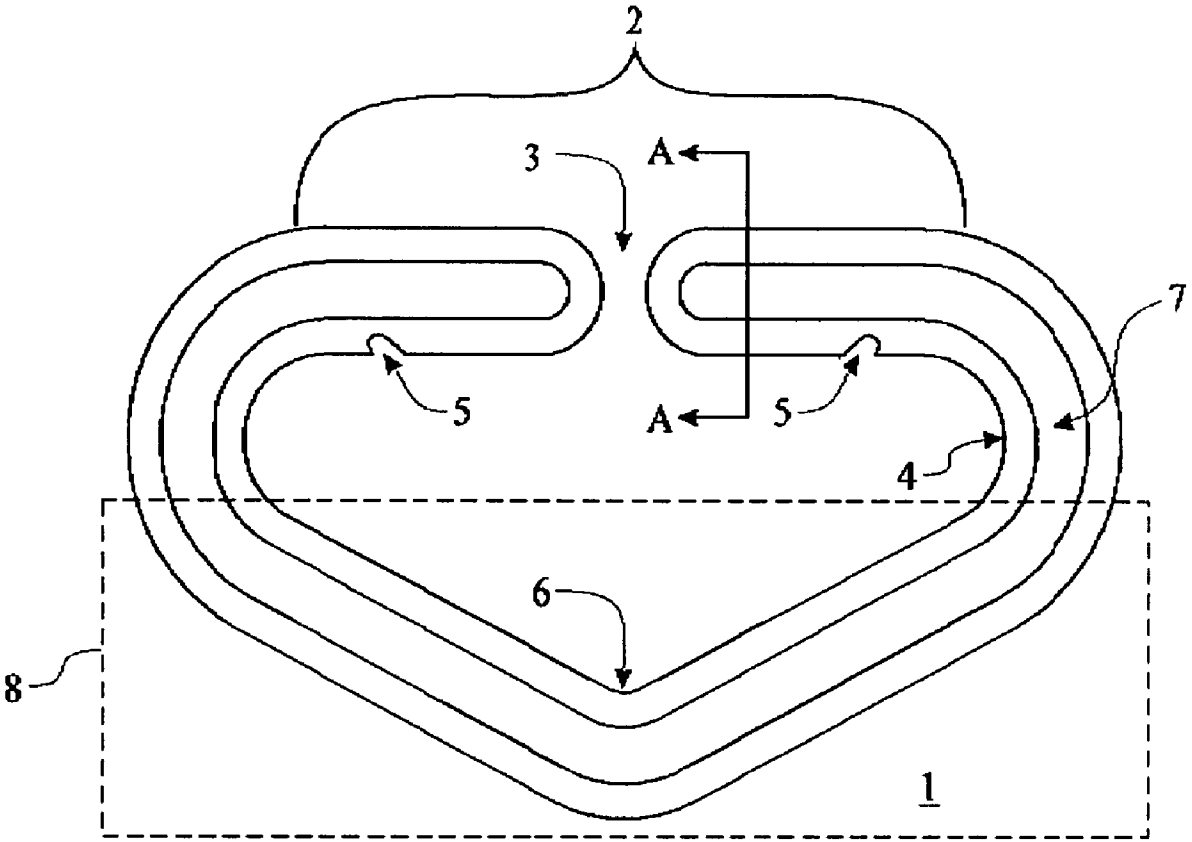
FIG. 1 illustrates a side view of one embodiment of the multi-bag carrying apparatus.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Reference is now made to the drawings, wherein like characteristics and features of the present invention shown in the various FIGURES are designated by the same reference numerals.

FIG. 1 illustrates a multi-bag carrying apparatus 1, said multi-bag carrying apparatus 1 comprising a carrying handle 2 and a carrying apparatus lower section 8. Said carrying apparatus lower section 8 is configured in a substantially "V shape" creating a lower interior apex area 6 with the apex proximate the center of said multi-bag carrying apparatus 1. Said carrying handle 2 section and said carrying apparatus lower section 8 are coupled preferably via a curved transitional section 4. Said curved transitional section 4 provides a contiguous transition between said carrying handle 2 section and said carrying apparatus lower section 8 while providing comfort to the user. Handles of one or multiple bags are inserted into said multi-bag carrying apparatus 1 thru a handle opening 3, wherein said handle opening 3 is incorporated in the top, gripping section, of the carrying handle 2 section of said multi-bag carrying apparatus 1. Said handle opening 3 incorporates a curved feature. The two opposing curved features create a funnel effect for both loading and unloading the bags. When said carrying handle 2 is grasped by a holder's hand, and picked up, along with the previously inserted handles of multiple bags, the holder's hand essentially covers said handle opening 3, and the bag handles (not shown) settle to the lower interior apex area 6 creating a center of gravity at said lower interior apex area 6 which will horizontally balance and stabilize the load carried, and vertically align the weight with the user's arm.

Said multi-bag carrying apparatus 1 further comprising two carrying ring notches 5 located in said carrying handle 2 section and are symmetric about said lower interior apex area 6. Said carrying ring notches 5 are preferably located in the interior section of said multi-bag carrying apparatus 1. Said carrying ring notches 5 are used for removably coupling of two "D Rings" (illustrated as D Rings 9 in FIGS. 3 and 4 herein), wherein said D Rings are used to secure a carrying strap (illustrated as carrying strap 11 in FIGS. 3 and 4 herein) to said multi-bag carrying apparatus 1. Said carrying ring notches 5 and the respective D rings are one example of a carrying strap coupling feature that those skilled in the art can incorporate for the same novel utility.

Figure 2:
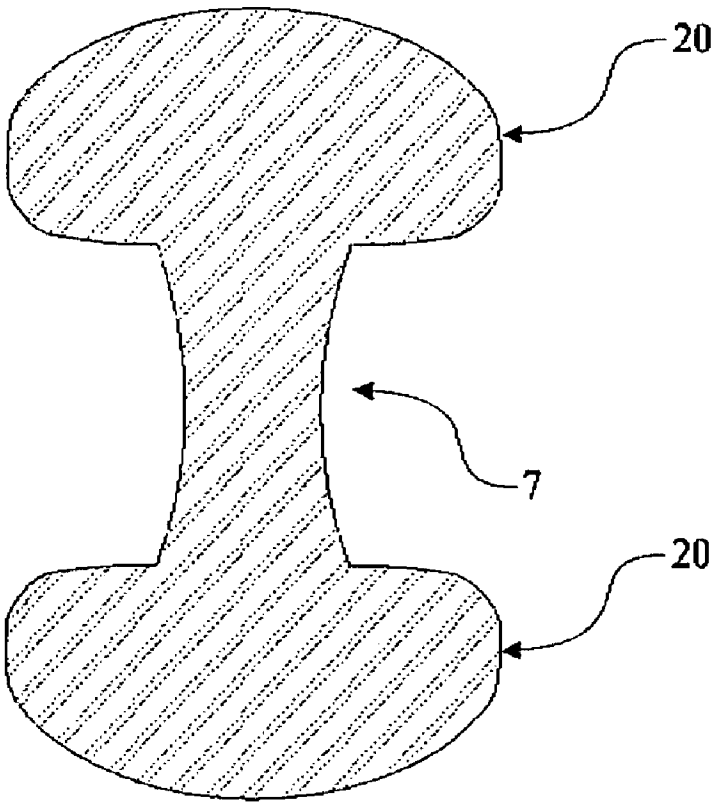
FIG. 2 illustrates a cross sectional view of the multi-bag carrying apparatus as presented in FIG. 1.

FIG. 2 presents cross section view A—A of said multi-bag carrying apparatus 1 presented in FIG. 1. The preferred cross section of said multi-bag carrying apparatus 1 is of an "I" shape comprising a vertical beam section 7 and a pair of beam section flanges 20, wherein said "I" shaped cross-section allows for increased strength, less weight of the handle body, more secure gripping surface for the users hand, and circulation of air through the vertical beam section 7 for more comfort for the user's hand. The exterior of said beam section flanges 20 are preferably rounded continuing the focus for comfort for the user's hand.

Figure 3:
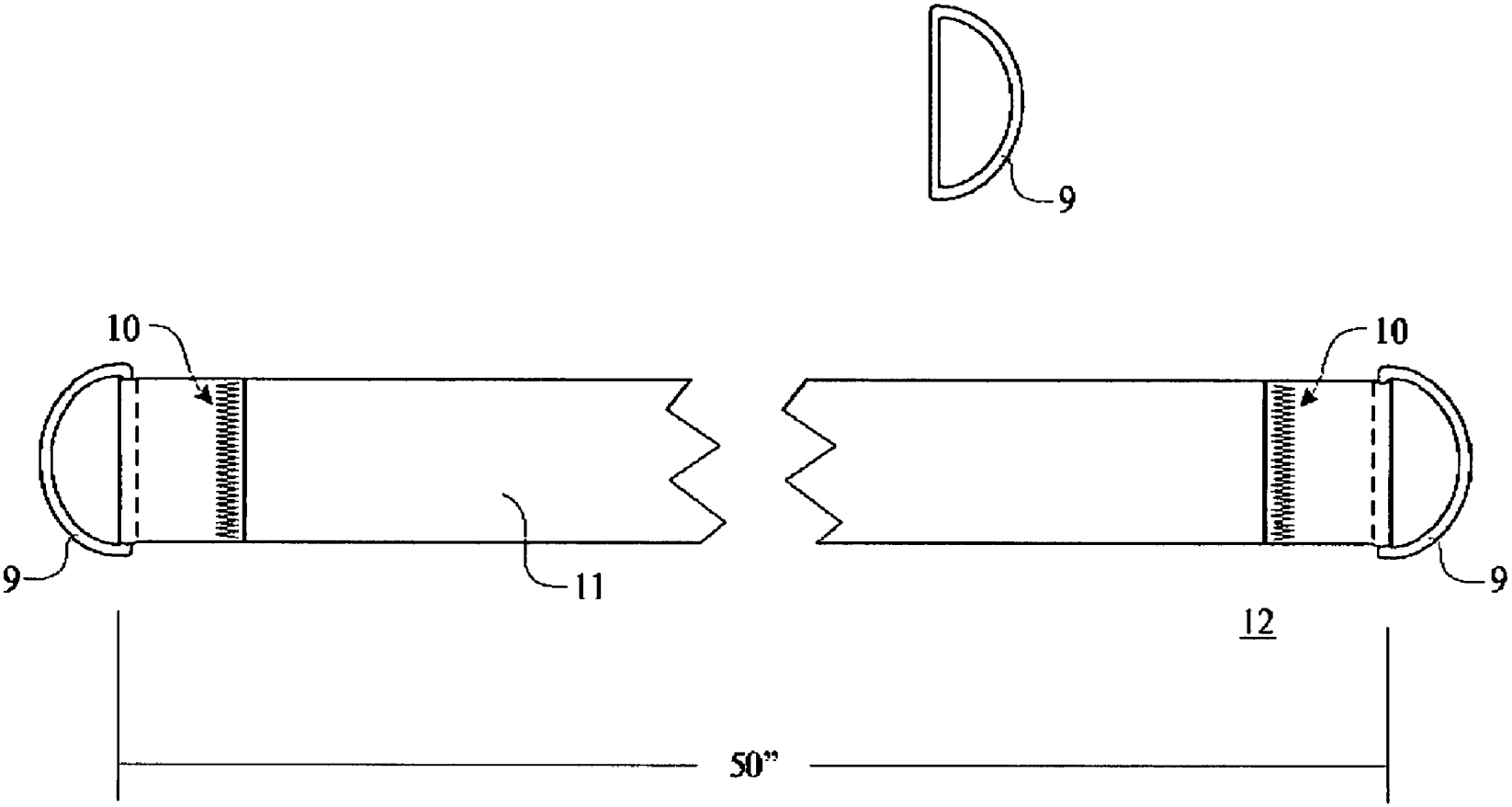
FIG. 3 illustrates a side view of a shoulder strap carrying assembly for use with the multi-bag carrying apparatus of FIG. 1, providing essentially handle-free carrying of the multi-bag carrying apparatus and the inserted objects with handles.

FIG. 3 illustrates a shoulder carrying strap 12, wherein said should carrying strap comprising a pair of D rings 9 coupled to a strap material 11 by looping said strap material 11 about said D ring 9 and stitching 10 said strapping material 11. Said shoulder carrying strap 12 allows for essentially hands free use so the user can open doors, handle keys, or use their hands for any purpose other than carry their bags.

Figure 4:
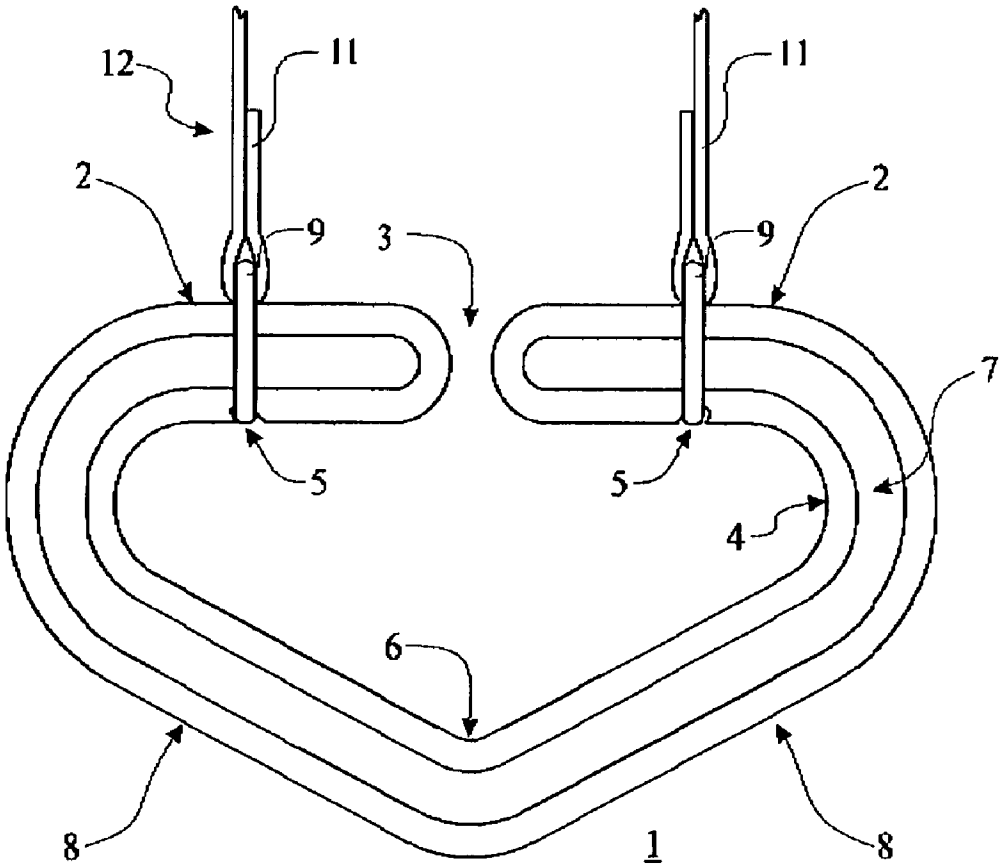
FIG. 4 illustrates a side view of the multi-bag carrying apparatus further illustrating the carrying strap of FIG. 3 installed.

FIG. 4 illustrates said shoulder carrying strap 12 assembled to said multi-bag carrying apparatus 1. Each of said D rings 9 and slipped through said handle opening 3 and secured into each of said carrying ring notches 5 as illustrated. The user would slide the handle of each item to be carried through said handle opening 3 of said carrying handle 2 towards said lower interior apex area 6. In the embodiment presented, the user would install at least one D ring 9 after the items to be carried are placed about said multi-bag carrying apparatus 1. The preferred method of installation would comprise inserting the two tight fitting, D rings 9 though the handle opening 3, moving the D rings 9 outward to a position aligned with each respective notch. Once aligned, the D rings 9 would be rotated into place, orienting the curved position of the D ring 9 securely fitting into the notched area and the linear portion of the D ring 9 along the top or exterior section of said carrying handle 2.

Said multi-bag carrying apparatus 1 can be fabricated of metal or plastic, preferably using an inexpensive manufacturing process such as injection molding or a rotating jig.

I claim:

1. A multi-bag carrying apparatus, said multi-bag carrying apparatus comprising:

a carrying apparatus lower section, wherein said carrying apparatus lower section comprising a left end, a right end, and a lower interior apex area, wherein said lower apex area is located between and below said left end and said right end, thus providing a gathering location for at least one of bag handles, straps, bands, loops, and hooks of a plurality of items to be carried proximate the center of said multi-bag carrying apparatus;

a horizontal top section for use as a carrying handle wherein said horizontal top section is oriented between said left end and said right end of said carrying apparatus lower section;

wherein said carrying apparatus lower section comprising a first side and an opposing side and wherein at least a portion of said horizontal top section is contiguous to each of said left end and right end of said carrying apparatus lower section;

a handle opening positioned within said horizontal top section, wherein said handle opening is for inserting at least one of bag handles, straps, bands, loops, and hooks of a plurality of items to be carried;

a carrying strap coupling feature comprising at least two carrying ring notches located in an interior edge of said horizontal top section for the attachment of a carrying strap; and a carrying strap that is removably coupled to said at least two carrying ring notches located in an interior edge of said horizontal top section.

2. The multi-bag carrying apparatus of claim 1, said multi-bag carrying apparatus is symmetric about a centered vertical axis.

3. The multi-bag carrying apparatus of claim 1, wherein said carrying strap is removably coupled via at least one D ring, wherein said D ring is coupled to said carrying strap and removably coupled to said horizontal top section of said multi-bag carrying apparatus via positioning said D ring to at least one carrying ring notch located in an interior edge of said horizontal top section.

4. The multi-bag carrying apparatus of claim 1, wherein at least a portion of a cross sectional area of said multi-bag carrying apparatus is rounded for user comfort.

5. The multi-bag carrying apparatus of claim 1, wherein at least one of said carrying lower section and said horizontal top section is of an "I" shaped cross sectional shape, wherein said "I" shaped cross sectional shape comprising a beam and at least one of a flange and a rounded flange.

6. The multi-bag carrying apparatus of claim 1, wherein said handle opening is at least one of located proximate the center of said horizontal top section and comprising a funneling loading and a funneling unloading feature.

7. A multi-bag carrying apparatus, said multi-bag carrying apparatus comprising:

a carrying apparatus lower section, wherein said carrying apparatus lower section comprising a left end, a right end, and a lower interior apex area, wherein said lower apex area is located between and below said left end and said right end, thus providing a gathering location for at least one of bag handles, straps, bands, loops, and hooks of a plurality of items to be carried proximate the center of said multi-bag carrying apparatus;

a horizontal top section for use as a carrying handle wherein said horizontal top section is oriented between said left end and said right end of said carrying apparatus lower section;

a handle opening positioned within said horizontal top section, wherein said handle opening is for inserting at least one of bag handles, straps, bands, loops, and hooks of a plurality of items to be carried; and a removably coupled carrying strap which is removably coupled to said horizontal top section of said multi-bag carrying apparatus, wherein said removably coupled carrying strap is removably coupled to said multi-bag carrying apparatus via at least two carrying ring notches located in an interior edge of said horizontal top section.

8. The multi-bag carrying apparatus of claim 7, wherein said carrying notch comprising at least one side of said carrying notch being non perpendicular to said horizontal top section.

9. The multi-bag carrying apparatus of claim 7, wherein said carrying strap is removably coupled via at least one D ring, wherein said D ring is coupled to said carrying strap and removably coupled to said horizontal top section of said multi-bag carrying apparatus via positioning said D ring to at least one carrying ring notch located in an interior edge of said horizontal top section.

10. The multi-bag carrying apparatus of claim 7, wherein at least a portion of a cross sectional area of said multi-bag carrying apparatus is rounded for user comfort.

11. The multi-bag carrying apparatus of claim 7, wherein at least one of said carrying apparatus lower section and said horizontal top section is of an "I" shaped cross sectional shape.

12. The multi-bag carrying apparatus of claim 7, wherein said handle opening is at least one of located proximate the center of said horizontal top section and comprising a funneling loading and a funneling unloading feature.

* * * * *